US009663341B2

(12) United States Patent
Lasnier et al.

(10) Patent No.: US 9,663,341 B2
(45) Date of Patent: May 30, 2017

(54) REFILLABLE BOTTLE FOR DISPENSING A FLUID PRODUCT

(71) Applicants: Jacky Lasnier, Sainte Marguerite sur Duclair (FR); Thomas Roosel, Notre Dame d'Aliermont (FR); Emmanuel Mauduit, Abbeville (FR)

(72) Inventors: Jacky Lasnier, Sainte Marguerite sur Duclair (FR); Thomas Roosel, Notre Dame d'Aliermont (FR); Emmanuel Mauduit, Abbeville (FR)

(73) Assignee: Albea Le Treport S.A.S. (FR)

( * ) Notice: Subject to any disclaimer, the term of this patent is extended or adjusted under 35 U.S.C. 154(b) by 178 days.

(21) Appl. No.: 14/026,712

(22) Filed: Sep. 13, 2013

(65) Prior Publication Data

US 2014/0069551 A1 Mar. 13, 2014

(30) Foreign Application Priority Data

Sep. 13, 2012 (FR) ..... 12 58604

(51) Int. Cl.
*B67C 3/28* (2006.01)
*B05B 11/00* (2006.01)
(Continued)

(52) U.S. Cl.
CPC ..... *B67C 3/28* (2013.01); *A45D 34/00* (2013.01); *B05B 11/0056* (2013.01); *B65B 3/06* (2013.01);
(Continued)

(58) Field of Classification Search
CPC ..... B67D 7/74; B67D 7/0294; A45D 34/00; A45D 2200/057; B67C 3/28; B05B 11/0056; B65B 3/003; B65B 3/06
(Continued)

(56) References Cited

U.S. PATENT DOCUMENTS 545,147 A * 8/1895 Benner ..... 141/29
2,345,854 A * 4/1944 Margolies ..... 239/355
(Continued)

FOREIGN PATENT DOCUMENTS

EP 0426408 A2 5/1991
FR 2904613 A1 2/2008
WO WO 9321103 A1 * 10/1993 ..... B67D 5/00

*Primary Examiner* — Timothy L Maust
*Assistant Examiner* — Andrew Schmid
(74) *Attorney, Agent, or Firm* — St. Onge Steward Johnston & Reens LLC

(57) ABSTRACT

A refillable bottle for dispensing a fluid product including a body in which a container for packaging the product is formed, the bottle including a device for dispensing the packaged product, which is mounted in a sealed manner on the body, the bottle being equipped with a valve for refilling the container arranged to enable a product source to be placed in communication with the container in order to refill the latter, the valve including a passage for communication between the source and the container, the passage having a seat equipped with a valve element that is mobile with respect to the seat between a closed position and a open position, the valve element being arranged so as to be mobile between its closed and open positions under the effect of gravity by the positioning of the bottle in an upright position and in an overturned position, respectively.

19 Claims, 4 Drawing Sheets

(51) Int. Cl.
*A45D 34/00* (2006.01)
*B65B 3/06* (2006.01)
*B65B 3/00* (2006.01)

(52) U.S. Cl.
CPC ..... *A45D 2200/057* (2013.01); *B65B 3/003* (2013.01)

(58) Field of Classification Search
USPC ..... 141/18, 113, 114, 115, 116, 118, 311 R, 141/319, 320, 325, 326, 330, 346, 347, 141/363, 364, 365, 366
See application file for complete search history.

(56) References Cited

U.S. PATENT DOCUMENTS 2,401,674 A * 6/1946 Vizay ..... 141/294
2,433,989 A * 1/1948 Hansen ..... 137/454
2,714,805 A * 8/1955 Zellweger ..... 141/330
2,906,300 A * 9/1959 Becher ..... 141/18
3,094,250 A * 6/1963 Molyneaux et al. ..... 222/207
3,205,919 A * 9/1965 Kovacs ..... 141/20.5
3,246,807 A * 4/1966 Micallef ..... 222/207
3,343,718 A * 9/1967 Siegel et al. ..... 222/1
3,556,171 A * 1/1971 Gangwisch et al. ..... 141/3
4,277,001 A * 7/1981 Nozawa ..... 222/321.4
5,072,762 A * 12/1991 Jimenez ..... 141/329
5,150,823 A * 9/1992 Sugita ..... 222/386
5,431,205 A * 7/1995 Gebhard ..... 141/351
5,524,680 A * 6/1996 de Laforcade ..... 141/18
5,839,623 A * 11/1998 Losenno et al. ..... 222/402.1
6,237,649 B1 * 5/2001 Moisio et al. ..... 141/100
6,240,979 B1 * 6/2001 Lorscheidt ..... 141/2
6,390,156 B1 * 5/2002 Hetherington et al. ..... 141/351
6,418,987 B1 * 7/2002 Colasacco ..... 141/384
6,648,180 B2 * 11/2003 Moon et al. ..... 222/185.1
6,863,093 B2 * 3/2005 Garcia et al. ..... 141/2
7,210,508 B2 * 5/2007 Behar ..... 141/329
7,377,296 B2 * 5/2008 Gueret ..... 141/352
8,118,066 B2 * 2/2012 Muhlhausen et al. ..... 141/18
8,152,025 B2 * 4/2012 Foster ..... 222/129
8,459,312 B2 * 6/2013 Manera et al. ..... 141/27
8,545,441 B2 * 10/2013 Matusch ..... 604/89
8,695,896 B2 * 4/2014 Tu ..... 239/333
2005/0016622 A1 * 1/2005 Risch et al. ..... 141/113
2005/0284891 A1 * 12/2005 Ramet et al. ..... 222/321.7
2007/0119517 A1 * 5/2007 Grace ..... 141/319
2008/0005828 A1 * 1/2008 Slade ..... 4/231
2009/0194191 A1 * 8/2009 Turgeman ..... 141/18
2011/0024465 A1 * 2/2011 Roosel et al. ..... 222/321.1
2011/0240677 A1 * 10/2011 Dwyer ..... 222/256
2011/0309110 A1 * 12/2011 Dumont et al. ..... 222/321.7
2012/0090730 A1 * 4/2012 Dumont et al. ..... 141/2
2012/0090733 A1 * 4/2012 Turgeman ..... 141/113
2012/0234432 A1 * 9/2012 Lamboux ..... 141/2
2012/0255647 A1 * 10/2012 Dumont et al. ..... 141/311 R
2012/0312842 A1 * 12/2012 Dumont et al. ..... 222/321.9
2012/0312843 A1 * 12/2012 Dumont et al. ..... 222/321.9
2013/0008981 A1 * 1/2013 Bloc et al. ..... 239/480
2013/0019991 A1 * 1/2013 Muller ..... 141/18
2014/0060695 A1 * 3/2014 Dumont et al. ..... 141/18
2014/0069551 A1 * 3/2014 Lasnier et al. ..... 141/18
2014/0083557 A1 * 3/2014 George et al. ..... 141/2
2014/0102584 A1 * 4/2014 Lasnier et al. ..... 141/18
2014/0102585 A1 * 4/2014 Lasnier et al. ..... 141/18
2014/0137983 A1 * 5/2014 Tu ..... 141/113
2014/0305543 A1 * 10/2014 Lasnier et al. ..... 141/18

* cited by examiner

REFILLABLE BOTTLE FOR DISPENSING A FLUID PRODUCT

FIELD OF THE INVENTION

The invention relates to a refillable bottle for dispensing a fluid product, as well as an assembly including such a bottle and a product source intended for refilling said bottle.

BACKGROUND OF THE INVENTION

In particular, the refillable bottle enables a liquid product to be dispensed, for example a cosmetic care, makeup or fragrance product or a pharmaceutical product.

The refillable bottle includes a body in which a container for packaging the product is formed, as well as a device for dispensing the packaged product, which is mounted in a sealed manner on said body. In particular, the dispensing device can include extraction means in the form of a manually actuated pump that is supplied with the packaged product, said pump being arranged so as to dispense the pressurized product, for example in the form of an aerosol. Alternatively, the dispensing device can include means for applying the product, for example in the form of a bead.

In one example of application, the refillable bottles according to the invention enable product samples to be dispensed, in particular for a product volume packaged in the container that is between 1 and 10 ml. In particular, the samples thus dispensed can enable a client to test the product, the bottles then being qualified as test sample bottles. Alternatively, the bottles can be "for bags" in that they enable a reduced volume of product to be carried easily, by contrast with bottles containing a larger volume, which are generally heavy and bulky because they are large.

In these applications, for example, for logistical reasons, practicality or environmental recycling reasons, it may be desirable to be capable of refilling the container with product from a source of said product. Indeed, it is impractical for a user to refill the container using a small funnel, and non-environmentally friendly to throw away an empty bottle in order to replace it with a full refill container.

Refillable bottles have already been offered for sale, in which the body is equipped with a valve for refilling the container that is arranged so as to enable a product source to be placed in communication with said container in order for the latter to be refilled. In particular, the valve includes a passage for communication between the source and the container, said passage having a seat equipped with a valve element that is mobile with respect to said seat between a sealed position of closing and a position of opening said passage.

To perform the refilling, the prior art proposes using a source bottle including a dispensing pump, the valve element being moved by means of the spray nozzle of said pump. In particular, the sealed contact of the spray nozzle on the valve element enables said valve element to be reversibly opened, and the pump to be actuated in order to inject the source product into the container through the valve.

However, this embodiment requires the pushbutton provided on the spray nozzle of the pump of the source bottle to be removed first, and said spray nozzle to be actuated several times in order to inject a sufficient volume of product, which is difficult and non-intuitive for the user. In addition, improper replacement of the pushbutton on the spray nozzle after refilling is potentially detrimental to the subsequent proper operation of the source bottle.

Moreover, this embodiment presents problems of sealing during refilling, in particular because of the difficulty of properly positioning the spray nozzle in sealed contact on the valve element and the pressure of injection of the product through the valve. In addition, the valves according to the prior art are not compatible with the different commercial spray nozzle configurations, which limits the possibilities of refilling a bottle equipped with such a valve, unless a set of adaptors is provided, which further complicates the sealed refilling.

SUMMARY OF THE INVENTION

The invention is intended to improve upon the prior art by proposing, in particular, a bottle of which the refilling action is simplified while the seal is improved, in particular without requiring a pressurized injection of the product into the container.

To this effect, according to a first aspect, the invention proposes a refillable bottle for dispensing a fluid product including a body in which a container intended for packaging said product is formed, said bottle including a device for dispensing said packaged product, which is mounted in a sealed manner on said body, said bottle being equipped with a valve for refilling the container, which is arranged so as to enable a product source to be placed in communication with said container in order for the latter to be refilled, said valve including a passage for communication between said source and said container, said passage having a seat equipped with a valve element that is mobile with respect to said seat between a position of sealed closing and a position of opening of said passage, the valve element being arranged so as to be mobile between its closing and opening positions by the effect of gravity caused by the positioning of the bottle in an upright position and in an overturned position, respectively.

According to a second aspect, the invention proposes an assembly including such a refillable bottle and a product source intended for refilling said refillable bottle, said source including a product container that is equipped with a bushing arranged so as to enable the sealed connection of the refilling valve on the source container by placing the passage in communication with said container.

BRIEF DESCRIPTION OF THE DRAWINGS

Other objectives and advantages of the invention will appear in the following description, provided with reference to the appended figures, wherein.

DETAILED DESCRIPTION OF THE INVENTION

Figure 5A:
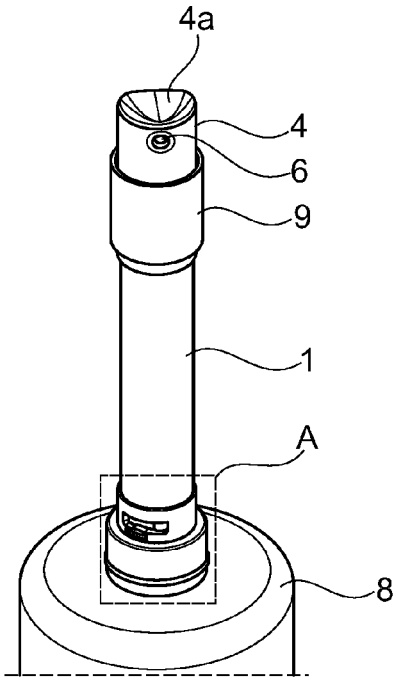
FIGS. 5*a-b* and 6*a-b* show the mounting of the refillable bottle on the source bottle (FIG. 5*a*) and their connection (FIG. 6*a*), FIGS. 5*b* and 6*b* being enlarged views of areas A of FIGS. 5*a* and 6*a*, respectively.
Figure 6A:
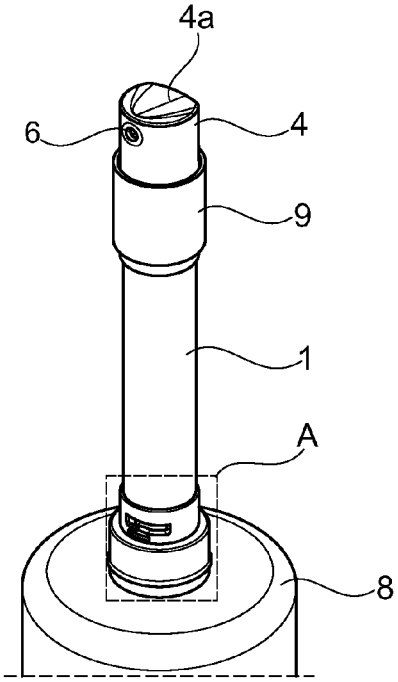
Figure 5B:
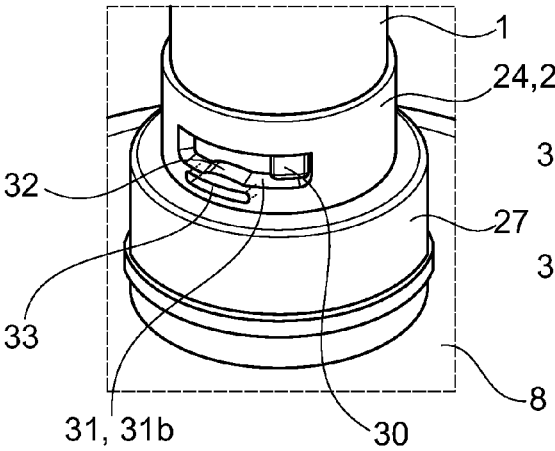
Figure 6B:
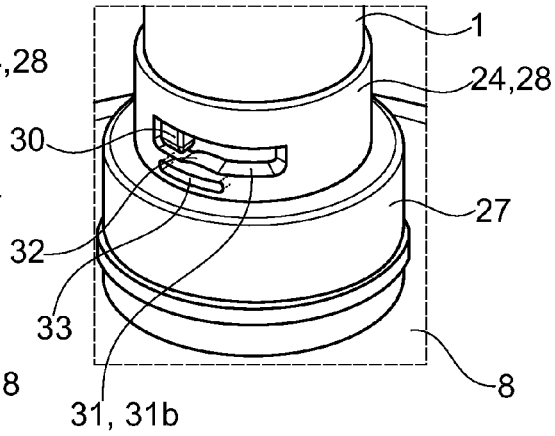
Figure 7A:
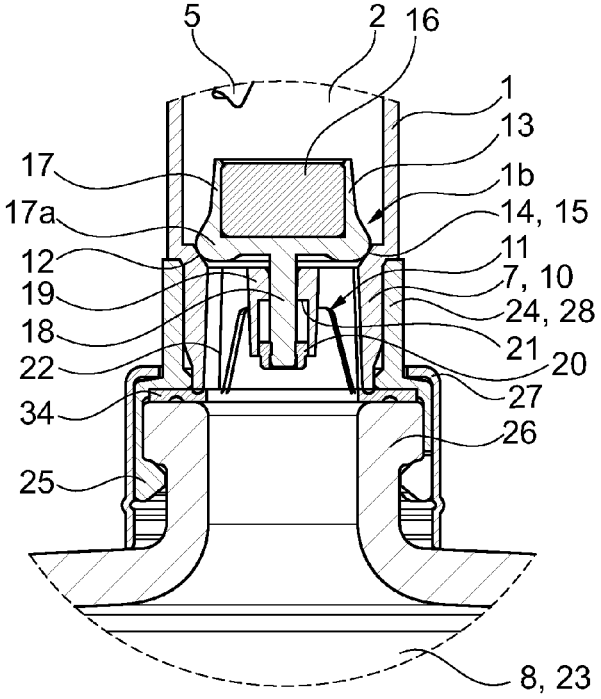
FIGS. 7*a-b* are partial and longitudinal cross-section representations of the connection of the refillable bottle on the source bottle, in an upright sealed closing position (FIG. 7*a*) and in an overturned position of opening the passage for refilling (FIG. 7*b*), respectively.

In the description, the terms of positioning in space are used in reference to the upright position of the refillable bottle as shown in particular in FIGS. 5, 6 and 7*a*.

In relation to the figures, a refillable bottle is described below which is intended to contain a fluid product to be dispensed. In particular examples, the product can be liquid, in particular a cosmetic care, makeup or fragrance product, or a pharmaceutical product.

The refillable bottle includes a body 1 in which a container 2 for packaging the product is formed. According to a particular application, the container 2 can have a capacity of between 1 and 10 ml so as to enable product samples to be dispensed.

In the embodiments shown, the body 1 is rigid, in particular having a rigidity sufficient for the volume of the container 2 to remain substantially constant, even if the internal pressure varies. The body 1 can be in one piece, for example produced by injection-blowing or extrusion-blowing, or in multiple parts that are injected then assembled, for example by ultrasound welding, or by laser, or by rotary friction, and made of rigid plastic, metal, for example aluminium, or glass.

The bottle includes a device for dispensing the packaged product that is mounted in a sealed manner in the body 1. In the embodiment shown, the dispensing device includes a pump 3 manually actuated by means of a pushbutton 4, said pump being supplied with the product by means of a plunger tube 5, which is arranged in the container 2.

However, the invention is not limited to one embodiment of the product. In particular, other types of means for extraction of the product in the container 2 can be envisaged. The dispensing device can also include means for application of the product, for example in the form of a bead.

The pushbutton 4 includes a dispensing orifice 6 and an upper area 4*a* enabling the user to exert finger pressure on it in order to move the spray nozzle of the pump 3 over its stroke for supplying said orifice with pressurized product. In the embodiment shown, the pushbutton 4 is equipped with a spray nozzle that is arranged in order to radially disperse an aerosol of the product through the dispensing orifice 6. However, in particular for a nasal spray end-piece, the pushbutton 4 can enable axial dispersal of the product. Alternatively, the product can be dispensed in the form of a drop or a layer.

The bottle is equipped with a valve 7 for filling the container 2, which is arranged so as to enable a product source 8 to be placed in communication with said container in order for it to be refilled. In relation to the figures, the body 1 has an upper opening 1*a* in which the pump 3 is mounted by means of a fret 9, and a lower opening 1*b*, which is equipped with the refilling valve 7.

The lower opening 1*b* is formed in the bottom of the body 1 and the refilling valve 7 includes a skirt 10 that extends axially peripherally under said opening. Thus, a passage 11 for communication between the product source 8 and the container 2 is formed, said passage extending into the skirt 10. In the figures, the skirt 10 is formed in a single piece with the body 1, but it can also be attached below it.

The communication passage 11 has a seat 12 equipped with a valve element 13 that is mobile with respect to said seat between a sealed positioning of closing and a position of opening said passage. In particular, the seat 12 can be formed on the periphery of the lower opening 1*b*.

Figure 7B:
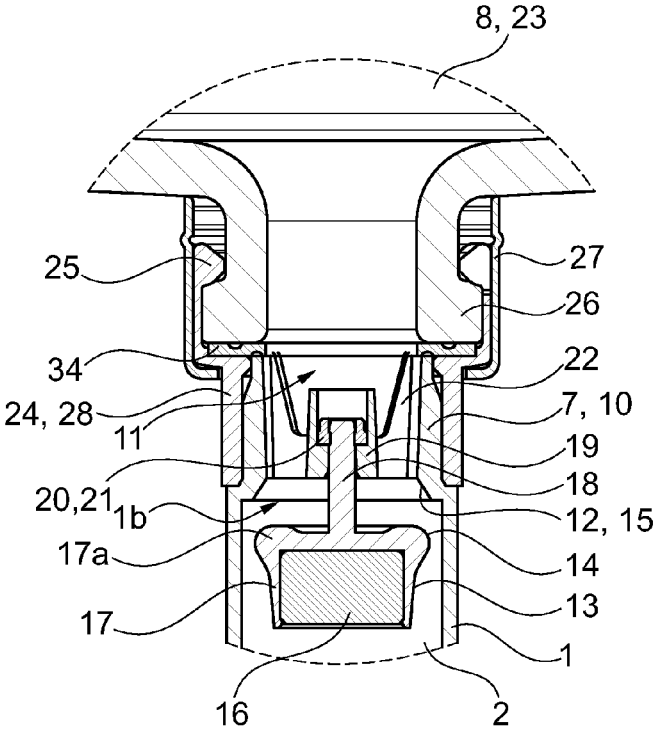

The valve element 13 is arranged so as to be mobile between its closing and opening positions under the effect of gravity caused by the positioning of the refillable bottle, respectively in an upright position (FIG. 7*a*) and in an overturned position (FIG. 7*b*). Thus, the refilling is performed by simple gravitational flow through the passage 11 between the product source 8 and the container 2 to be refilled, the refilling being capable of being performed by a simple action of mounting the refillable bottle in the upright position on the product source 8 followed by overturning the refillable bottle—product source 8 assembly.

In the embodiment shown, the upright position corresponds to the normal position of use of the refillable bottle in which the pushbutton 4 is arranged toward the top. Alternatively, the refillable bottle in the upright position can be oriented differently, provided that the valve element 13 is in the closing position under the effect of gravity.

The refillable bottle in the upright position can be mounted and connected on the product source 8 without causing a transfer of product, in particular due to the absence of pressurization of said product. Then, the overturned position corresponds to a rotation of the refillable bottle—product source 8 assembly in order to arrange said source above the container 2 in order to cause refilling by flowing. In FIGS. 7, the rotation is 180°, but it can have a different angle, provided that it is sufficient to open the valve element 13 under the effect of gravity.

After refilling, the refillable bottle—product source assembly 8 is returned to its initial position before disconnecting said bottle in order to be capable of using it subsequently. In particular, this overturning causes the valve element 13 to close under the effect of gravity.

In relation to the figures, the valve element 13 includes an annular portion 14 that, in the closing position, comes into sealed contact on a complementary portion 15 of the seat 12 (FIG. 7*a*), said portion in the opening position being arranged at a distance from said complementary portion (FIG. 7*b*). To improve the sealing in the closing position, the portions 14, 15 can be frustoconical.

Moreover, the valve element 13 is equipped with a ballast element 16 of which the weight is sufficient to move said valve element between its opening and closing positions. In particular, the ballast element 16 causes a sealed pressing force of the annular portion 14 on the complementary portion 15 and ensures the detachment of said portions during the overturning.

In the embodiment shown, the valve element 13 is capable of moving in axial translation between its closing and opening positions. Alternatively, optionally complementarily, the valve element 13 can be mobile between its closing and opening positions by deformation caused by gravity, in particular by deformation of the annular portion 14 on the seat 12.

In the figures, the valve element 13 includes an upper enclosure 17 having a lower rim 17*a* on which the annular portion 14 is formed, an attached ballast element 16, for example metal-based, being fixed in said enclosure. Alternatively, the ballast element 16 can be integrated with the valve element 13, in particular by producing said valve element with a high-density material, for example a polymer filled with metallic particles or a metallic material.

The valve element 13 includes a lower rod 18 that extends under the enclosure 17, said rod being slidingly mounted in a tube 19 secured to the skirt 10, said rod and said tube being arranged so as to define the end of stroke of movement of the valve element 13 in the opening position. In particular, the rod 18 is equipped with an attached end-piece 20 that cooperates with a narrowing 21 of the tube 19 to form an end-of-stroke stop. Alternatively, the end-piece 20 can be integrated with the rod 18 and includes retractable shape-memory means.

Figure 1:
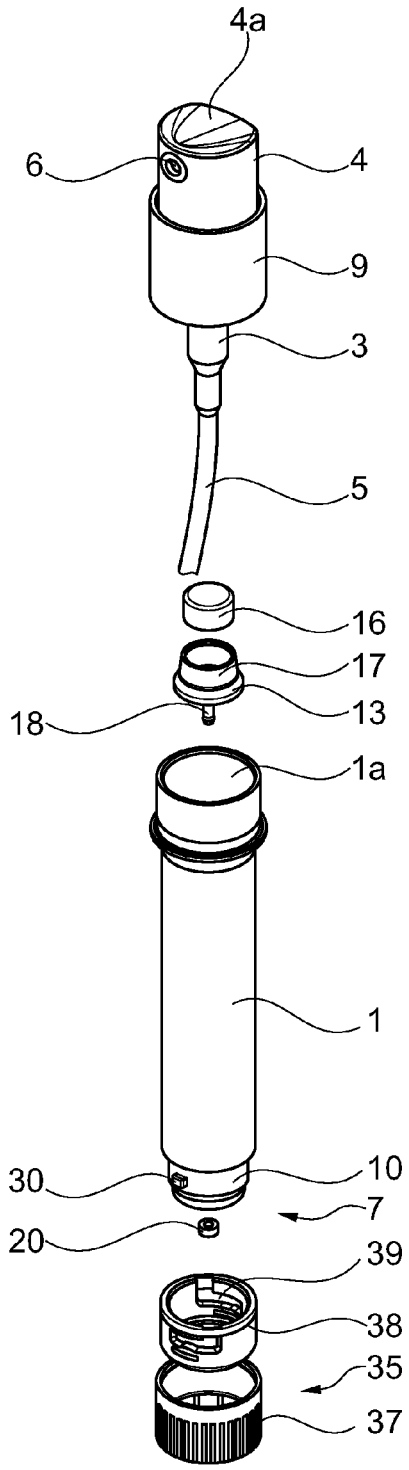
FIG. 1 is an exploded representation of a refillable bottle according to an embodiment of the invention.
Figure 2:
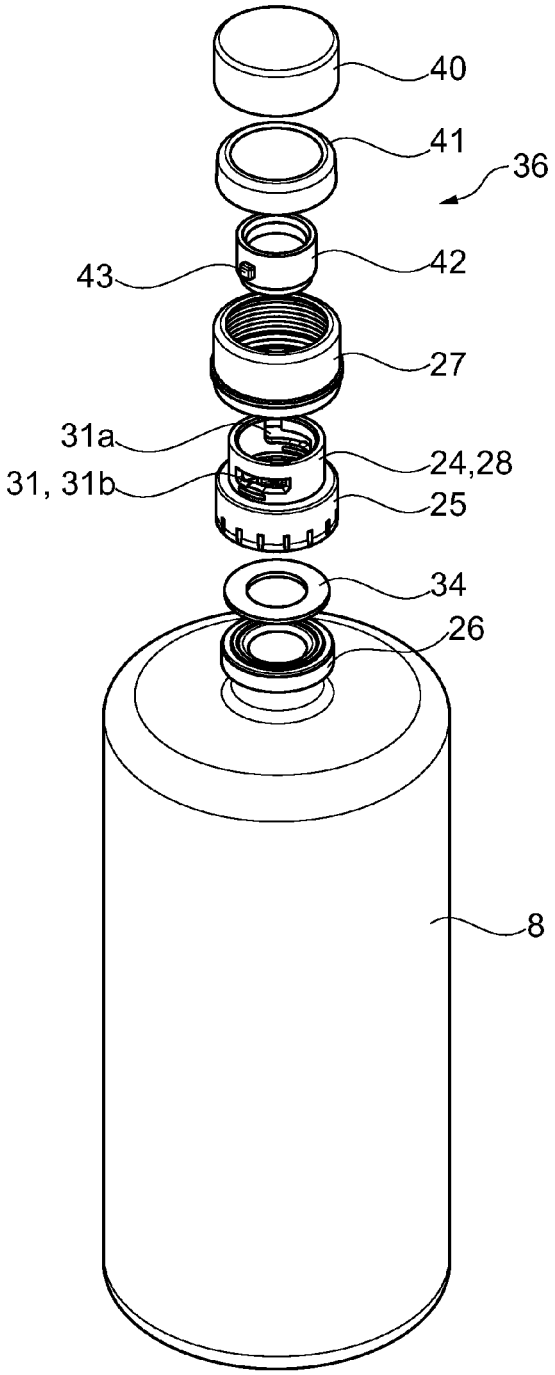
FIG. 2 an exploded representation of a source bottle according to an embodiment of the invention.
Figure 4A:
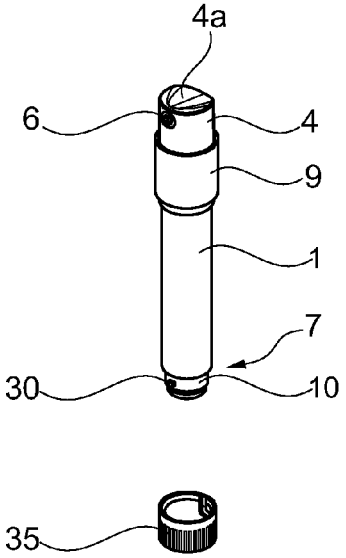
FIGS. 4*a-d* are partial representations showing the communication passage of the refilling valve of the refillable bottle according to FIG. 1, in perspective (FIG. 4*a*), in a transverse cross-section (FIG. 4*b*) and in a longitudinal cross-section (FIGS. 4*c* and 4*d*), respectively.
Figure 4A:
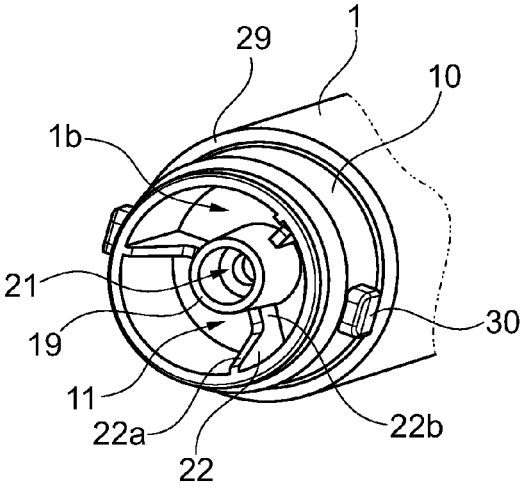
Figure 3:
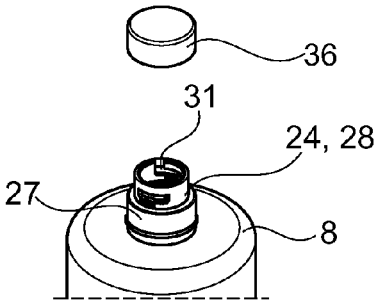
FIG. 3 shows, in perspective, the assembly formed by the refillable bottle of FIG. 1 and the source bottle according to FIG. 2, each being assembled and ready to be connected.
Figure 4B:
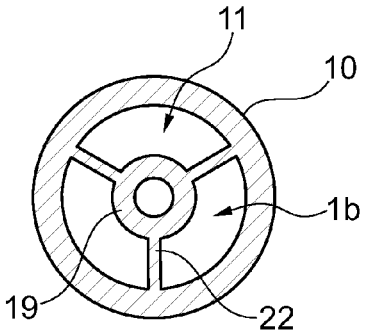
Figure 4C:
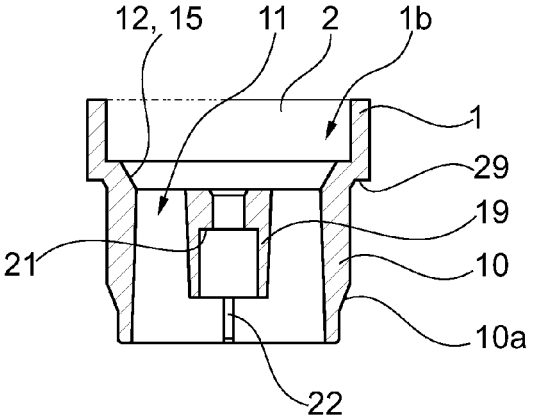
Figure 4D:
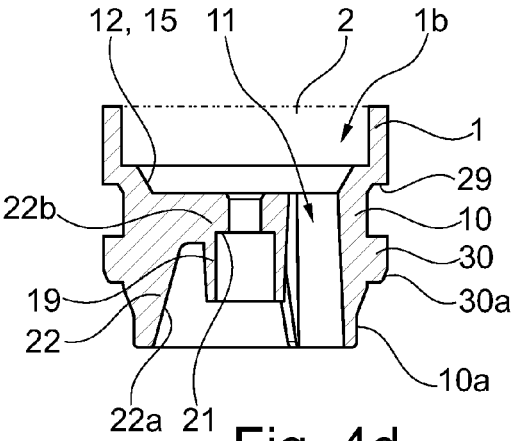

The tube 19 is mounted in the skirt 10 by means of at least one rib 22. In relation to FIG. 4*b*, three ribs 22 are provided to form three openings in the communication passage 11. The ribs 22 are arranged to promote a parietal flow of the product in the communication passage 11, in particular by being connected inside the skirt 10 over substantially its entire axial dimension and each having a free edge 22*a* that converges toward a radial base 22*b* connected to the periphery of the tube 19.

Thus, when the refillable bottle returns to the upright position at the end of the refilling, the flow in the source 8 of the product contained in the communication passage 11 is promoted so as to prevent a leakage of product under the refillable bottle when it is disconnected.

Similarly, the refilling valve 7 can have surfaces of which the hydrophobicity is arranged so as to promote the flow of the product in the communication passage 11. In particular the interior of the valve 7 can be made hydrophobic, for example by fluorine plasma treatment, soaking in a silicone bath or by making the refilling valve 7 with a hydrophobic material such as PTFE.

The product source 8 includes a product container 23, in particular formed inside a bottle with a capacity greater than that of the refillable bottle. According to another embodiment, the source container 23 is formed inside a flexible pouch that can be refilled with product without air or gas for good preservation of said product.

The source container 23 is equipped with a bushing 24 that is arranged to enable the sealed connection of the refilling valve 7 on said source container by placing the passage 11 in communication with it. In addition, the refilling valve 7 is equipped with a device for sealed connection of the bottle on the product source 8, the bushing 24 being equipped with a connection device that is complementary to that of the refilling valve 7.

In the figures, the bushing 24 includes a mounting collar 25 on the neck 26 of the source bottle 8, said collar being fixed on said neck by means of a fret 27. The collar 25 has an upper opening on which a sleeve 28 is mounted and extends axially peripherally. Advantageously, the bushing 24 has no means for pressurizing the refilling product. Thus, the bottle 8 cannot be diverted from its role as source since it has not propulsion gas or internal pressure.

The skirt 10 of the refilling valve 7 is arranged so as to slide axially with respect to the sleeve 28 of the bushing 24. In particular, the skirt 10 and the sleeve 28 are annular, the exterior diameter of the skirt 10 being slightly less than the interior diameter of the sleeve 28 so as to enable axial mounting without play of the refillable bottle on the product source 8.

In addition, the skirt 10 can be slightly frustoconical and have a lower chamfer 10*a* so as to ensure radial tightening during the axial sliding of said skirt into the sleeve 28. Moreover, the skirt 10 is connected to the body 1 by means of a radial portion 29 on which the upper end of the sleeve 28 comes into axial abutment at the end of the sliding.

In the embodiment shown, the connection devices include lugs 30 secured to the skirt 10 or the sleeve 28 which are intended to cooperate with ramps 31 secured to the sleeve 28 or the skirt 10 so as to enable the mounting and immobilization of the refillable bottle in the connected position on the source container 23. In the figures, a play of two diametrally opposed lugs 30 is formed around the skirt 10 in order to cooperate with a play of two ramps 31 formed in the sleeve 28, said lugs being inscribed in a diameter that is substantially equal to that of the body 1 and having a lower chamfer 30*a* facilitating their insertion into the ramps 31.

The ramps 31 include an axial portion 31*a* for sliding of the lugs 30 and a peripheral portion 31*b* for rotation of said lugs. Thus, a bayonet type action is obtained in order to connect the refillable bottle on the product source 8 in a sealed manner. In the figures, the peripheral portions 31*b* include an embossment 32 for locking the lugs 30 in the connected position. In addition, the skirt 10 includes holes 33 that are arranged under the embossments 32 to facilitate their deformation during the locking.

An annular seal 34 is inserted between the sleeve 28 and the neck 26, the lower end of the skirt 10 coming into axial contact on said seal when the refillable bottle is mounted on the product source 8. Thus, by compression of the seal 34, the sealing of the connection of the passage 11 through which the product flows during refilling is ensured.

Advantageously, the refilling valve 7 and/or the bushing 24 are equipped with a cap 35, 36 arranged so as to maintain the sealing of the containers 2, 23 between two refills. Each cap 35, 36 includes a connection device that is complementary to that of the refilling valve 7 or the bushing 24. Thus, the caps 35, 36 can be removed before refilling and put back on after refilling according to an action that is analogous to that of the disconnection and the connection of the refillable bottle on the product source 8, respectively.

In the figures, the cap 35 of the refilling valve 7 has a sheath 37 in which a cap body 38 is mounted, said body having ramps 39 that are analogous to the ramps 31 of the sleeve 28. Similarly, the cap 36 of the bushing 24 includes a sheath 40 in which a cap body 41 is mounted, said body being equipped with an indexer 42 on which lugs 43 analogous to the lugs 30 of the skirt 10 are formed.

What is claimed is:

1. A refillable bottle for dispensing a liquid cosmetic product, comprising:

a body in which a container for packaging said product is formed, said body having an upper opening in a top of said body, and a lower opening formed opposite to the upper opening in a bottom of the body;

a device for dispensing said packaged product, which is included and mounted in a sealed manner in the upper opening of said body;

a refilling valve in the lower opening of said body for refilling the container that is arranged so as to enable a product source to be placed in communication with said container in order to refill the latter, said refilling valve including a passage for communication between said product source and said container, said passage having a seat equipped with a valve element that is mobile with respect to said seat between a sealed position of closing and a position of opening said passage; and said bottle being characterized in that the valve element is arranged so as to be mobile between its closing and opening positions under the effect of gravity caused by the positioning of the bottle in an upright position and in an overturned position, respectively.

2. The refillable bottle according to claim 1, characterized in that the refilling valve is equipped with a device for sealed connection of said bottle on the product source.

3. The refillable bottle according to claim 1, characterized in that the valve element includes an annular portion that, in the closing position, comes into sealed contact on a complementary portion of the seat, said portion in the opening position being arranged at a distance from said complementary portion.

4. The refillable bottle according to claim 3, characterized in that valve element is equipped with a ballast element of which the weight is sufficient to move said valve element between its opening and closing positions.

5. The refillable bottle according to claim 1, characterized in that the refilling valve includes a skirt in which the communication passage extends.

6. The refillable bottle according to claim 5, characterized in that the valve element includes a lower rod that is slidingly mounted in a tube secured to the rod.

7. The refillable bottle according to claim 6, characterized in that the rod and the tube are arranged so as to define the end of stroke of movement of the valve element in the opening position.

8. The refillable bottle according to claim 6, characterized in that the tube is mounted in the skirt by means of at least one rib that is arranged in order to promote a parietal flow of the product in the communication passage.

9. The refillable bottle according to claim 1, characterized in that the refilling valve has surfaces of which the hydrophobicity is arranged to promote the flow of product in the communication passage.

10. An assembly including a refillable bottle according to claim 1 and a product source intended for refilling said refillable bottle, said source including a product container that is equipped with a bushing arranged so as to enable the sealed connection of the refilling valve on the source container by placing the passage in communication with said container.

11. The assembly according to claim 10, characterized in that the refilling valve is equipped with a device for sealed connection of said bottle on the product source and the bushing is equipped with a connection device that is complementary to that of the refillable bottle.

12. The assembly according to claim 11, characterized in that the refilling valve includes a skirt in which the communication passage extends and the skirt is arranged so as to slide axially with respect to a sleeve of the bushing, the connection devices including lugs secured to the skirt—or the sleeve—which are intended to cooperate with ramps secured to the sleeve—or the skirt—so as to enable the mounting and immobilization of the refillable bottle in a connected position on the source container.

13. The assembly according to claim 12, characterized in that the ramps include an axial portion for sliding of the lugs and a peripheral portion for rotation of said lugs, said peripheral portions including an embossment for locking said lugs in the connected position.

14. The assembly according to claim 12, characterized in that it includes a seal on which the skirt is intended to come into axial contact.

15. The assembly according to claim 11, characterized in that the refilling valve and/or the bushing are equipped with a cap including a connection device that is complementary to that of said refilling valve or said bushing.

16. The refillable bottle according to claim 2, characterized in that the valve element includes an annular portion that, in the closing position, comes into sealed contact on a complementary portion of the seat, said portion in the opening position being arranged at a distance from said complementary portion.

17. The refillable bottle according to claim 7, characterized in that the tube is mounted in the skirt by means of at least one rib that is arranged in order to promote a parietal flow of the product in the communication passage.

18. The assembly according to claim 13, characterized in that it includes a seal on which the skirt is intended to come into axial contact.

19. The refillable bottle according to claim 1, wherein the device for dispensing said conditioned product is removably mounted in the upper opening of said body.

* * * * *